US008699932B2

(12) United States Patent
Tanda

(10) Patent No.: US 8,699,932 B2
(45) Date of Patent: Apr. 15, 2014

(54) FIXING UNIT AND IMAGE FORMING APPARATUS WITH BUILT-IN FIXING UNIT

(75) Inventor: Tetsuo Tanda, Osaka (JP)

(73) Assignee: Kyocera Mita Corporation (JP)

( * ) Notice: Subject to any disclaimer, the term of this patent is extended or adjusted under 35 U.S.C. 154(b) by 214 days.

(21) Appl. No.: 13/169,178

(22) Filed: Jun. 27, 2011

(65) Prior Publication Data

US 2011/0318075 A1 Dec. 29, 2011

(30) Foreign Application Priority Data

Jun. 28, 2010 (JP) ..... 2010-146675

(51) Int. Cl.
*G03G 15/20* (2006.01)

(52) U.S. Cl.
USPC ..... 399/331; 399/122; 399/328

(58) Field of Classification Search
USPC ..... 399/122, 320, 328–331, 334, 335
See application file for complete search history.

(56) References Cited

U.S. PATENT DOCUMENTS

2006/0285893 A1 12/2006 Ishii
2008/0317526 A1 * 12/2008 Fujimori et al. ..... 399/329
2009/0148206 A1 * 6/2009 Yoshikawa ..... 399/331
2009/0175644 A1 7/2009 Nanjo et al.
2009/0208262 A1 * 8/2009 Osada et al. ..... 399/329
2009/0245898 A1 * 10/2009 Gon et al. ..... 399/328
2009/0245902 A1 10/2009 Gon et al.
2010/0014900 A1 1/2010 Gon

FOREIGN PATENT DOCUMENTS

JP 04-143759 5/1992
JP 2006-030245 2/2006
JP 2006-323074 11/2006
JP 2009-139674 6/2009

* cited by examiner

*Primary Examiner* — Walter L Lindsay, Jr.
*Assistant Examiner* — Jessica L Eley
(74) *Attorney, Agent, or Firm* — Gerald E. Hespos; Michael J. Porco; Matthew T. Hespos

(57) ABSTRACT

A fixing unit is provided with a heating mechanism configured to define an arcuate heating zone, a heating roller including a circumferential surface extending along the heating zone, a belt wound on the heating roller along the circumferential surface, a tensioner configured to apply tension to the belt; and a biasing mechanism configured to bias the tensioner in a biasing direction along an extending direction of the belt between the heating roller and the tensioner.

6 Claims, 8 Drawing Sheets

FIXING UNIT AND IMAGE FORMING APPARATUS WITH BUILT-IN FIXING UNIT

BACKGROUND OF THE INVENTION

1. Field of the Invention

The present invention relates to a fixing unit for fixing a toner image to a sheet and an image forming apparatus with the built-in fixing unit.

2. Description of the Related Art

An image forming apparatus such as a copier, a facsimile machine or a printer typically includes a fixing unit configured to fix a toner image to a sheet. A certain type of fixing units includes a heating roller and a pressure roller to be pressed to the heating roller. While a sheet bearing a toner image passes through a nip portion between the heating roller and the pressure roller, the toner image is fixed to the sheet.

Another type of fixing units includes a heated belt and a pressure roller to be pressed to the belt. While a sheet passes through a nip portion between the belt and the pressure roller, a toner image is fixed to the sheet.

The aforementioned belt-type fixing unit includes a heating roller on which the belt is wound, and a fixing roller configured to nip the belt with the pressure roller, in addition to the above belt and pressure roller. The belt is wound on the heating roller and the fixing roller. The fixing unit includes a tension roller configured to maintain the tension of the belt. The tension roller stabilizes the belt tracking.

The aforementioned fixing unit includes a heating mechanism for induction-heating the belt and the heating roller. The tension roller is typically biased in a direction orthogonal to a travel path of the belt defined between the heating roller and the fixing roller.

The tension roller biased in the direction orthogonal to the travel path of the belt defined between the heating roller and the fixing roller changes a distance between the heating mechanism and the belt. For example, when the belt tension goes down, the tension roller is displaced in a direction away from a straight line connecting the rotation axes of the heating and fixing rollers. When the belt tension goes up, the tension roller is displaced in a direction toward the straight line connecting the rotation axes of the heating and fixing rollers.

The movements of the tension roller toward and away from the straight line connecting the rotation axes of the heating and fixing rollers change a distance between the belt and the heating mechanism at the start and/or end points of a heating zone defined by the heating mechanism. The change in the distance between the belt and the heating mechanism becomes a disturbance factor for a temperature control of the belt to eventually cause failures in a toner image fixing process.

The aforementioned failure is found not only in the induction heating type fixing units, but also commonly found in fixing units including another heating mechanism configured to supply heat energy to an outer surface of a belt.

SUMMARY OF THE INVENTION

An object of the present invention is to provide a fixing unit and an image forming apparatus which suitably perform a toner image fixing process.

One aspect according to the present invention is directed to a fixing unit for fixing a toner image, comprising a heating mechanism configured to define an arcuate heating zone; a heating roller including a circumferential surface extending along the heating zone; a belt wound on the heating roller along the circumferential surface; a tensioner configured to apply tension to the belt; and a biasing mechanism configured to bias the tensioner in a biasing direction along an extending direction of the belt between the heating roller and the tensioner.

Another aspect according to the present invention is directed to an image forming apparatus, comprising the aforementioned fixing unit.

These and other objects, features and advantages of the present invention will become more apparent upon reading the following detailed description along with the accompanying drawings.

DETAILED DESCRIPTION OF THE PREFERRED EMBODIMENTS

Hereinafter, a fixing unit and an image forming apparatus according to one embodiment are described with reference to the drawings. It should be noted that directional terms such as "upper", "lower", "left" and "right" used hereinafter are merely for clarifying the description and not of the nature to limit the principle of the fixing unit and the image forming apparatus.

Image Forming Apparatus

Figure 1:
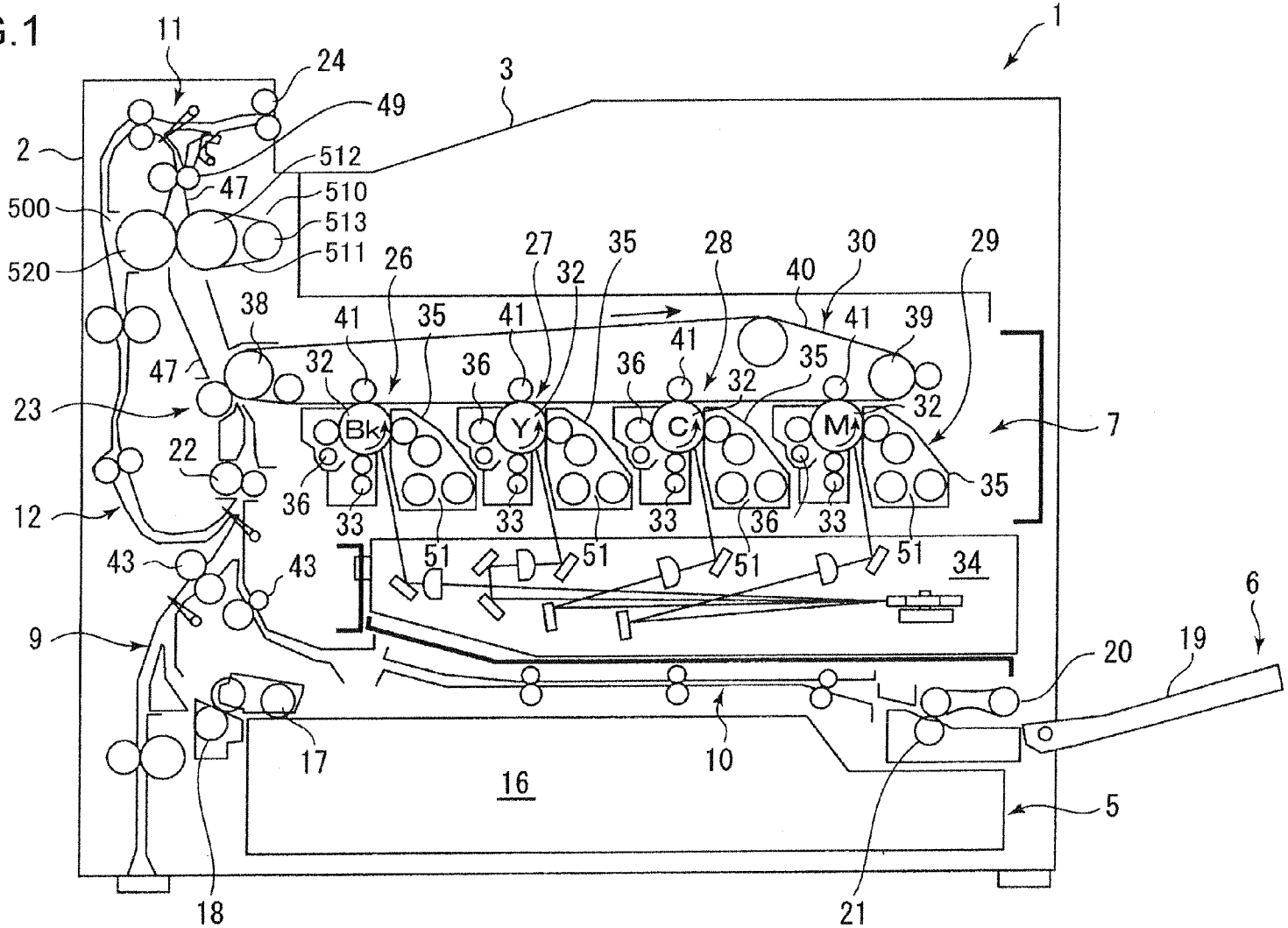
FIG. 1 shows a schematic configuration of an image forming apparatus with a built-in fixing unit according to one embodiment.

FIG. 1 is a schematic diagram showing configuration of an image forming apparatus with a fixing unit. The image forming apparatus shown in FIG. 1 is a tandem color printer. It should be noted that the principle according to this embodiment may be applied to printers, copiers, facsimile machines, complex machines provided with these functions or other apparatuses configured to transfer and print a toner image to and on a surface of a printing medium based on externally input image information.

The image forming apparatus 1 includes a rectangular boxed housing 2. A color image is formed on a sheet in the housing 2. A discharge section 3 is provided at the upper surface of the housing 2. A sheet after the color image printing is discharged to the discharge section 3. The sheet may be, for example, a copy sheet, a postcard, an OHP sheet, tracing paper or another printing medium on which a toner image may be formed.

The housing 2 accommodates a sheet cassette 5 configured to feed sheets and an image forming station 7. Further, a stack tray 6 used to manually feed sheets is attached to the housing 2. The stack tray 6 is arranged above the sheet cassette 5. The image forming station 7 arranged above the stack tray 6 forms an image on a sheet based on image data such as characters and pictures transmitted from the outside of the image forming apparatus 1.

A first conveyance path 9 is defined in the left portion of the housing 2 shown in FIG. 1. A sheet fed from the sheet cassette 5 is conveyed to the image forming station 7 through the first conveyance path 9. A second conveyance path 10 is defined above the sheet cassette 5. A sheet fed from the stack tray 6 is conveyed from the right side to the left side of the housing 2 through the second conveyance path 10 and reaches the image forming station 7. A fixing unit 500 configured to perform a fixing process on a sheet after an image forming process performed by the image forming station 7 and a third conveyance path 11 for conveying the sheet after the fixing process to the discharge section 3 are provided in an upper left portion of the housing 2.

The sheet cassette 5 is configured to be drawn outside of the housing 2 (e.g. right side of FIG. 1). A user may draw out the sheet cassette 5 to replenish the sheet cassette 5 with sheets. The sheet cassette 5 includes a storing portion 16. The user may selectively store various sheets in sizes into the storing portion 16. A feed and separation rollers 17, 18 feed the sheets in the storing portion 16 one by one.

The stack tray 6 is vertically rotatable between a closed position where it lies along an outer surface of the housing 2 and an open position (shown in FIG. 1) where it projects from the outer surface of the housing 2. A user places sheets on a manual feeding portion 19 of the stack tray 6 one by one. Alternatively, the user may place several sheets on the manual feeding portion 19. The sheets placed on the manual feeding portion 19 are fed toward the second conveyance path 10 one by one by pickup and separation rollers 20, 21.

The first and second conveyance paths 9, 10 join before registration rollers 22. A sheet reached the registration rollers 22 is temporarily stopped by the registration rollers 22. The registration rollers 22, thereafter, perform a skew adjustment and a timing adjustment for the sheet. After the adjustments for the skew and the timing, the registration rollers 22 feed the sheet toward a secondary transfer unit 23. A full color toner image on an intermediate transfer belt 40 is secondarily transferred to the sheet, which has sent to the secondary transfer unit 23. After the secondary transfer, the sheet is fed to the fixing unit 500. The fixing unit 500 fixes the toner image to the sheet. Optionally, a new full color toner image may be formed on the other side of the sheet in the secondary transfer unit 23 after the toner image is fixed on one side of the sheet (duplex printing). In the case of the duplex printing, after the toner image is fixed to one side of the sheet, the sheet is sent out to a fourth conveyance path 12 to be reversed. A new toner image formed on the other side of the sheet in the secondary transfer unit 23 is fixed by the fixing unit 500. Thereafter, the sheet is conveyed along the third conveyance path 11 and discharged to the discharge section 3 by discharge rollers 24.

The image forming station 7 includes four image forming units 26 to 29 configured to form toner images of black (Bk), yellow (Y), cyan (C) and magenta (M), respectively. The image forming station 7 further includes an intermediate transfer unit 30. The intermediate transfer unit 30 superposes and carries toner images formed by these image forming units 26 to 29.

Each of the image forming units 26 to 29 includes a photoconductive drum 32 and a charger 33 facing the circumferential surface of the photoconductive drum 32. Each of the image forming units 26 to 29 includes a laser scanning unit 34 configured to emit laser beams to the circumferential surface of the photoconductive drum 32 in accordance with image data such as characters and pictures transmitted from the outside of the image forming apparatus 1. The laser beams from the laser scanning unit 34 irradiate the circumferential surfaces of the photoconductive drums 32 at downstream positions of the chargers 33. Each of the image forming units 26 to 29 further includes a developing unit 35 facing the circumferential surface of the photoconductive drum 32. The developing unit 35 supplies toner to the circumferential surface of the photoconductive drum 32, which bears an electrostatic latent image formed by the irradiation of the laser beam, and forms a toner image. The toner image formed on the circumferential surface of the photoconductive drum 32 is transferred to the intermediate transfer unit 30 (primary transfer). Each of the image forming units 26 to 29 further includes a cleaner 36 facing the circumferential surface of the photoconductive drum 32. The cleaner 36 cleans the circumferential surface of the photoconductive drum 32 after the primary transfer.

The photoconductive drums 32 of the respective image forming units 26 to 29 shown in FIG. 1 are rotated in counterclockwise directions by drive motors (not shown). Black toner, yellow toner, cyan toner and magenta toner are stored in toner boxes 51 of the developing units 35 of the image forming units 26 to 29, respectively.

The intermediate transfer unit 30 includes a rear roller (drive roller) 38 arranged near the image forming unit 26, a front roller (idler) 39 arranged near the image forming unit 29, and the intermediate transfer belt 40 extending between the rear roller 38 and the front roller 39. The intermediate transfer unit 30 further includes four transfer rollers 41 configured to press the intermediate transfer belt 40 against the photoconductive drums 32 of the image forming units 26 to 29, respectively. The transfer rollers 41 press the intermediate transfer belt 40 against the circumferential surfaces of the photoconductive drums 32, which bears toner images formed by the developing units 35, and executes the transfer (primary transfer) of the toner images to the intermediate transfer belt 40.

As a result of the transfer of the toner images to the intermediate transfer belt 40, the toner images formed by the black toner, the yellow toner, the cyan toner and the magenta toner are superimposed on the intermediate transfer belt 40 into a full color toner image.

The first conveyance path 9 extends toward the intermediate transfer unit 30. A sheet fed from the sheet cassette 5 reaches the intermediate transfer unit 30 through the first conveyance path 9. Several conveyor rollers 43 for conveying the sheet are arranged in position along the first conveyance path 9. The registration rollers 22 arranged before the intermediate transfer unit 30 adjust a feed timing of the sheet passing in the first conveyance path 9 in synchronization with the image forming operation of the image forming station 7.

The fixing unit 500 heats and presses the sheet. As a result, the unfixed toner image formed on the sheet immediately after the secondary transfer is fixed. The fixing unit 500 includes a belt unit 510 with a belt 511, and a reference roller 520 configured to nip the sheet with the belt 511. The belt unit 510 includes first and second rollers 512, 513 on which the belt 511 is wound. In this embodiment, the second roller 513 is exemplified as a heating roller including a circumferential surface extending along a heating zone defined by a heating mechanism to be described later.

Conveyor rollers 49 are arranged after the fixing unit 500. A conveyance path 47 extending from the secondary transfer unit 23 toward the conveyor rollers 49 is formed in the housing 2. The sheet conveyed through the intermediate transfer unit 30 is introduced to a nip portion formed between the reference roller 520 and the belt 511 through the conveyance path 47. The toner image is fixed to the sheet in the nip portion. The sheet passed in between the reference roller 520 and the belt 511 is, then, guided to the third conveyance path 11 through the conveyance path 47.

The conveyor rollers 49 feed the sheet to the third conveyance path 11. The third conveyance path 11 guides the sheet after the fixing process by the fixing unit 500 to the discharge section 3. The discharge rollers 24 arranged at the exit of the third conveyance path 11 discharge the sheet to the discharge section 3.

Fixing Unit

Figure 2:
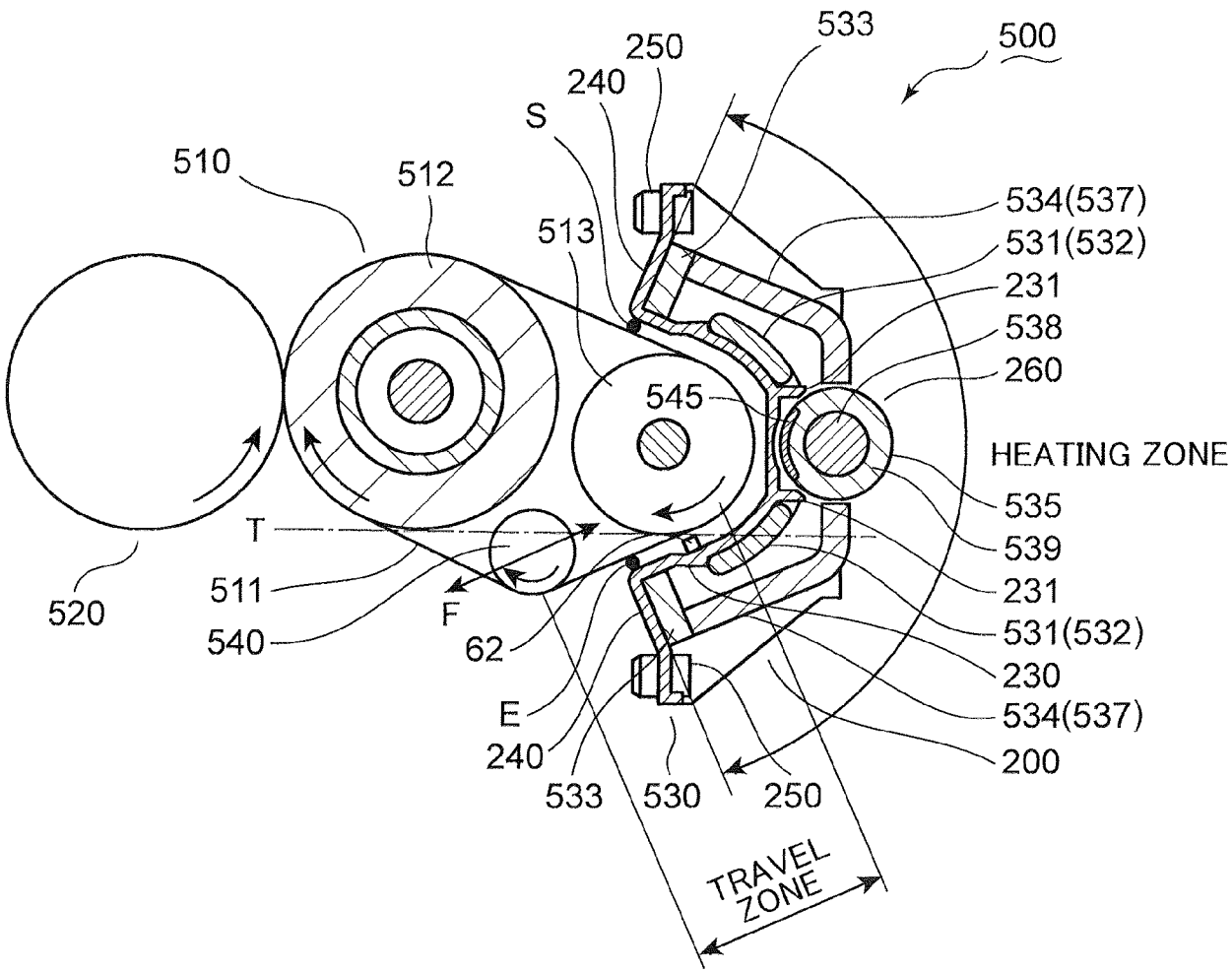
FIG. 2 is a schematic sectional view of the fixing unit provided in the image forming apparatus shown in FIG. 1.
Figure 3:
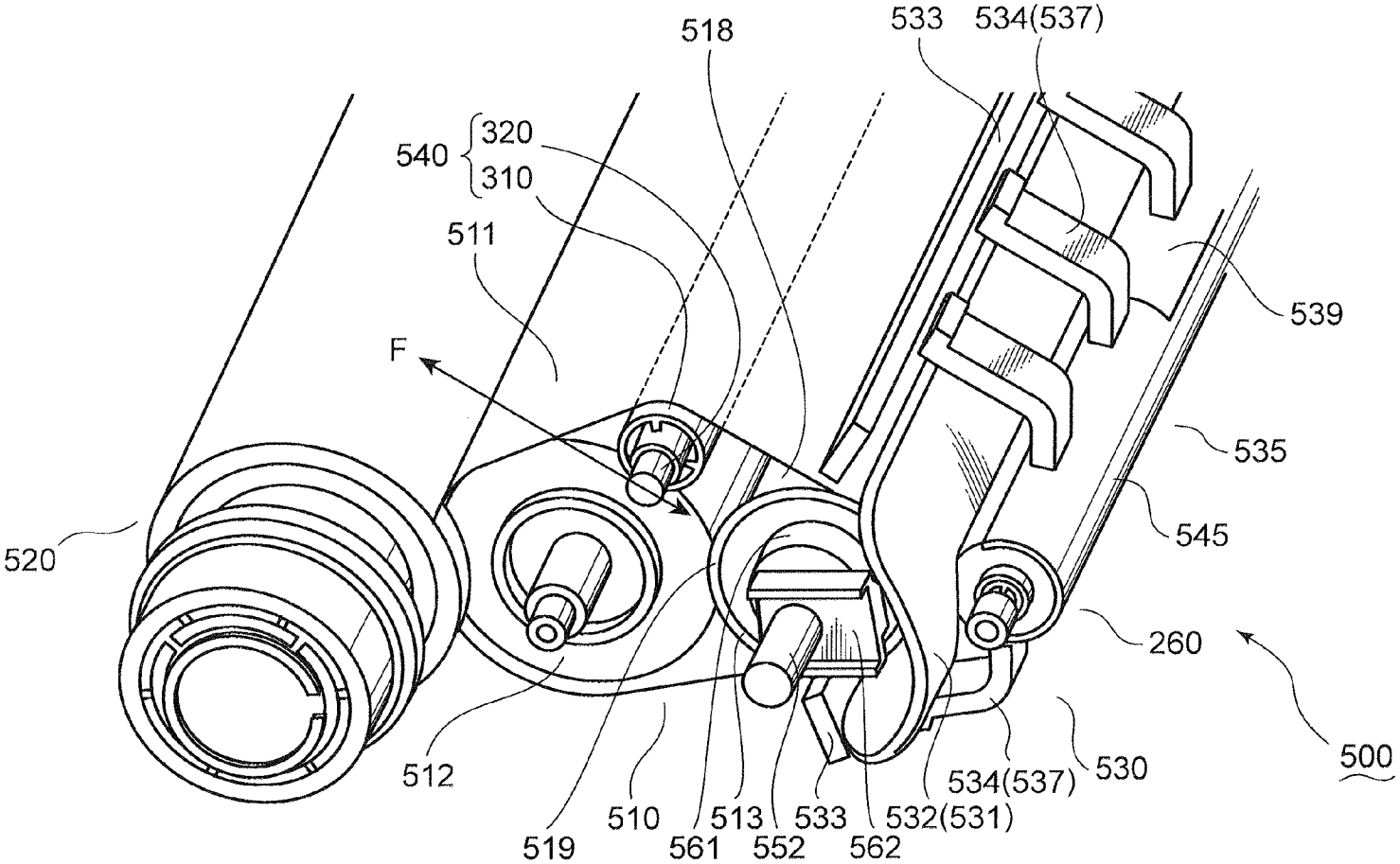
FIG. 3 is a schematic perspective view of the fixing unit shown in FIG. 2.

FIG. 2 is a schematic sectional view of the fixing unit 500. FIG. 3 is a schematic perspective view of the fixing unit 500. The fixing unit 500 is described with reference to FIGS. 1 to 3.

Heating Mechanism

The fixing unit 500 includes an IH coil unit 530 configured to heat the belt 511 and the second roller 513, in addition to the aforementioned belt unit 510 and reference roller 520. In this embodiment, the IH coil unit 530 is exemplified as the heating mechanism.

The IH coil unit 530 adjacent to the second roller 513 includes a platform 200 having a substantially Ω-shaped cross section (see FIG. 2). It should be noted that the platform 200 is not shown in FIG. 3. The platform 200 made of non-conductive heat resistant resin (e.g. PPS, PET or LCP) and formed into a thin plate includes a substantially semicylindrical curved portion 230. The curved portion 230 includes a pair of end edges substantially parallel to the rotation axis of the second roller 513. The platform 200 further includes a pair of ear portions 240 in the form of flat plates, which extend from the paired end edges of the curved portion 230, respectively. The paired ear portions 240 are fixed to the housing 2 of the image forming apparatus 1 using suitable fixing pieces 250 (e.g. bolts).

The curved portion 230 includes a pair of positioning walls 231 projecting in directions away from the second roller 513. The positioning walls 231 extend substantially in parallel to the rotation axis of the second roller 513. The IH coil unit 530 includes a coil 531 fixed to the curved portion 230. The coil 531 including an enameled wire wound around the paired positioning walls 231 as a base forms a coil surface 532 lying down along the curved portion 230.

The IH coil unit 530 includes a power supply (not shown) configured to supply power to the coil 531. The coil 531 generates a magnetic field by the supplied power from the power supply.

The IH coil unit 530 includes a magnetic element 260 configured to define paths of magnetic lines in the magnetic field generated from the coil 531. The magnetic element 260 includes a pair of side cores 533 in the form of flat plates, which are fixed to the paired ear portions 240, respectively. The side cores 533 are formed of, e.g. ferrite. The paths of the magnetic lines in the magnetic field generated from the coil 531 pass through the side cores 533. Thus, the paired side cores 533 define start and endpoints S, E of a heating zone induction-heated by the magnetic field from the coil 531. The IH coil unit 530 induction-heats the belt 511 wound along the circumferential surface of the second roller 513 as well as the second roller 513 in the arcuate heating zone from the start point S to the end point E (see FIG. 2).

The magnetic element 260 further includes a center core 535 arranged at the center of the heating zone and arch cores 534 extending between the paired side cores 533 and the center core 535. The arch cores 534 are formed of, e.g. ferrite. The center core 535 is arranged substantially in parallel to the second roller 513. The center core 535 is partially surrounded by the inner edge of the coil surface 532. The base ends of the arch cores 535 are connected to the side cores 533. The other ends of the arch cores 534 are proximate to the circumferential surface of the center core 535. The coil surface 532 is arranged in an area surrounded by the center core 535, the arch cores 534, the side cores 533 and apart of the belt 511 present in the heating zone.

Figure 4:
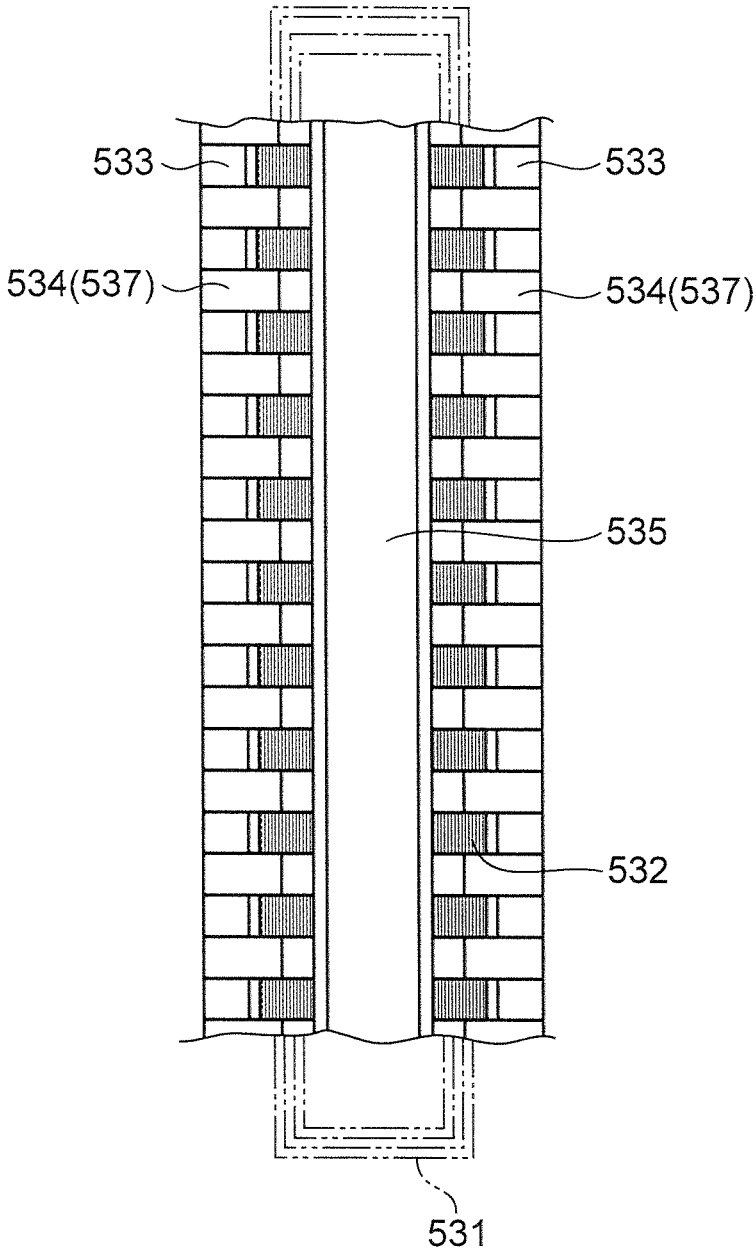
FIG. 4 schematically shows an IH coil unit provided in the fixing unit shown in FIG. 2.

FIG. 4 schematically shows the coil 531, the side cores 533, the arch cores 534 and the center core 535 placed on the platform 200. The IH coil unit 530 is further described with reference to FIGS. 2 to 4.

Each arch core 534 includes arch core pieces 537 arranged at several positions at intervals to be aligned, for example, in a longitudinal direction of the center core 535. The arch core pieces 537 may be substantially L-shaped ferrite members of about 10 mm in width. A denser arrangement of the arch core pieces 537 may result in more efficient heating. On the other hand, a coarser arrangement of the arch core pieces 537 may contribute to a reduction in manufacturing cost and weight of the fixing unit 500. Accordingly, it is preferable that the arrangement density of the arch core pieces 537 is appropriately determined on the basis of the heating efficiency, manufacturing cost and/or weight saving. In this embodiment, several arch core pieces 537 are aligned at equal intervals. Alternatively, the arrangement of the arch core pieces 537 may become coarser near the longitudinal center position of the center core 535 while it may become denser near the ends of the center core 535. Clearances between the arch core pieces 537 may be determined to be ranged from, for example, from ⅓ to ½ of the width of the arch core pieces 537.

Each side core 533 may be formed of successively arranged ferrite plates from 30 mm to 60 mm in length. The arrangements of the arch cores 534 and the side cores 533 may be determined, for example, in accordance with a magnetic flux density (field intensity) distribution of the magnetic field generated from the coil 531. In areas free from the arch core pieces 537, the side cores 533 compensate for a focusing effect of the magnetic field to uniformize a magnetic flux density distribution (temperature difference) in the longitudinal direction of the center core 535.

Figure 5:
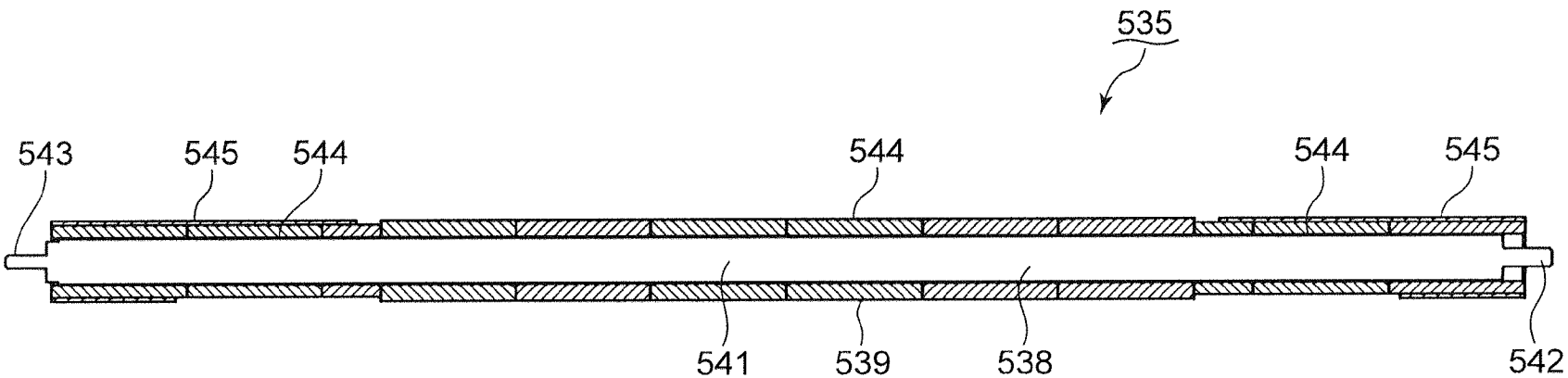
FIG. 5 is a schematic sectional view of a center core of the IH coil unit shown in FIG. 4.

FIG. 5 is a longitudinal sectional view of the center core 535. The IH coil unit 530 is further described with reference to FIGS. 2, 3 and 5.

The center core 535 includes a cylindrical conductive shaft 538 and a cylindrical magnetic tube 539 covering the conductive shaft 538. The magnetic tube 539 is bonded to the conductive shaft 538, for example, using silicon adhesive. The cylindrical magnetic tube 539 is, for example, 14 mm to 20 mm in outer diameter. The conductive shaft 538 includes a trunk 541 configured to be fitted into the cylindrical magnetic tube 539 and a pair of journals 542, 543. The journals 542, 543 are thinner than the trunk 541. The journals 542, 543 coaxial with the trunk 541 project to the outside of the magnetic tube 539. The conductive shaft 538 is preferably made of nonmagnetic stainless steel. It is likely that the conductive shaft 538 made of stainless steel prevents the center core 535 from deforming. It should be noted that the journals 542, 543 are preferably covered by a nonconductive member. Thus, it is less likely that current is transferred from the coil 531 to the conductive shaft 538.

The magnetic tube 539 includes substantially cylindrical magnetic tube pieces 544. The magnetic tube pieces 544 are formed of, e.g. ferrite. The several magnetic tube pieces 544 are connected along the conductive shaft 538. The magnetic tube pieces 544 arranged at longitudinal central positions of the conductive shaft 538 is longer in outer diameter than the magnetic tube pieces 544 located at the left and right ends of the trunk 541 of the conductive shaft 538. Magnetic shielding plates 545 partially cover the outer circumferential surfaces of the smaller magnetic tube pieces 544 in diameter so as to fill steps between the magnetic tube pieces 544 located at the center of the conductive shaft 538 and those located at the left and right ends of the conductive shaft 538. In this embodiment, circumferential surface areas of the center core 535 on which the magnetic shielding plates 545 mounted are exemplified as shielding areas where the paths of the magnetic lines propagating toward the second roller 513 are shielded.

The magnetic shielding plates 545 are preferably made of a more conductive and nonmagnetic material (e.g. oxygen-free copper). Penetration of a magnetic field perpendicular to the surfaces of the magnetic shielding plates 545 generates an induction current. This induction current generates a reverse magnetic field to cancel interlinkage flux (perpendicular penetrating magnetic field). As a result, the magnetic shielding plates 545 may shield the magnetic field. It is less likely that the magnetic shielding plates 544 made of more conductive material cause Joule heat resulting from the induction current, so that the magnetic shielding plates 544 efficiently shield the magnetic field. The magnetic shielding plates 545 made of a material having a smaller specific resistance and/or the thicker magnetic shielding plates 545 is more conductive. The magnetic shielding plates 545 is preferably 0.5 mm or larger in thickness. The magnetic shielding plates 545 of about 1 mm in thickness are used in this embodiment.

Figure 6:
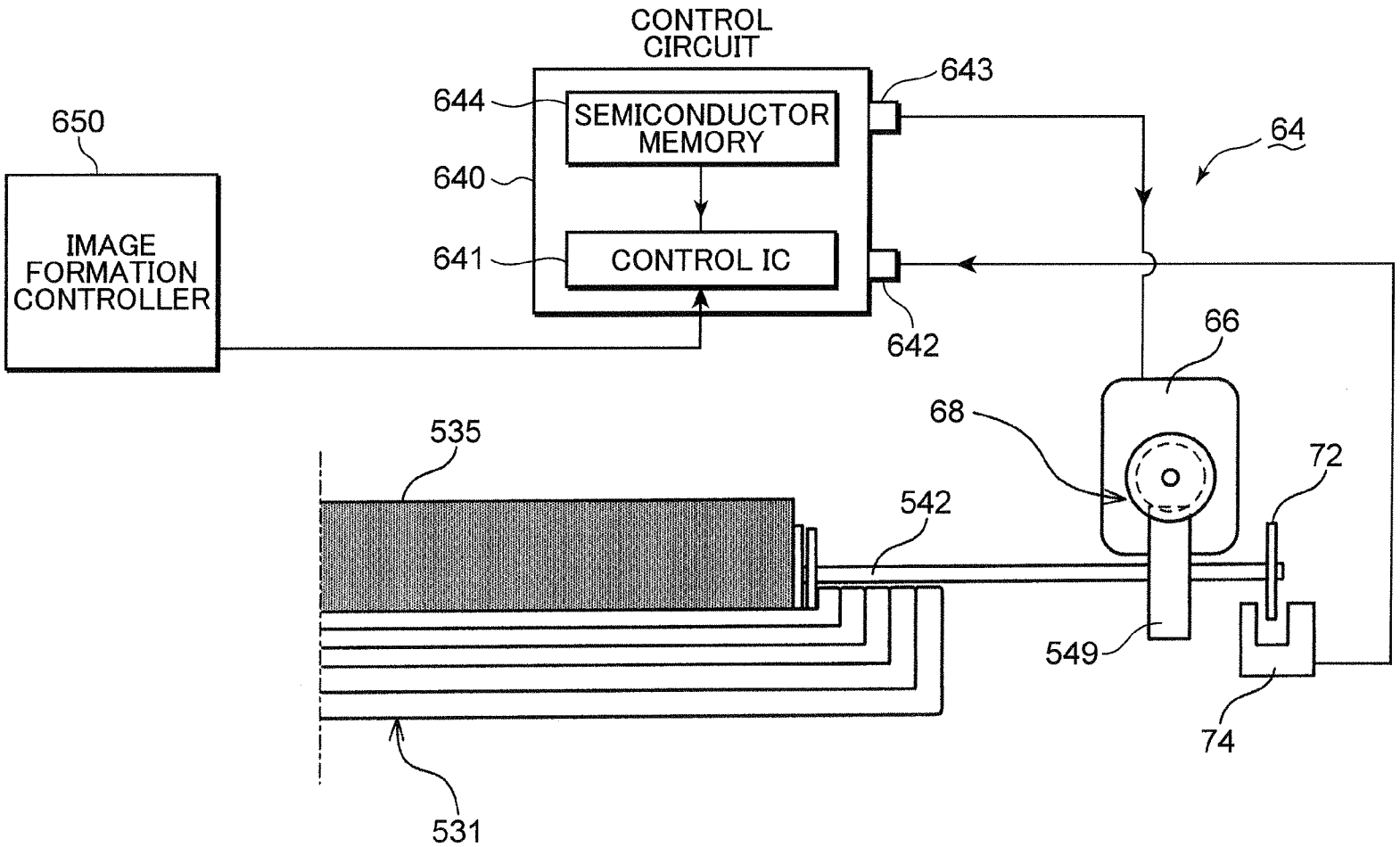
FIG. 6 is a schematic block diagram of a driving mechanism for the center core shown in FIG. 4.

FIG. 6 shows configuration of a driving mechanism connected to the center core 535. The driving mechanism configured to rotate the center core 535 is described with reference to FIGS. 1, 5 and 6.

The driving mechanism 64 rotates the center core 535 via the journal 542 (or journal 543). The positions of the magnetic shielding plates 545 are changed by the rotation of the center core 535. The movement of the magnetic shielding plates switches the paths of the magnetic lines in the magnetic field generated by the power supply to the coil 531.

The driving mechanism 64 includes, for example, a stepping motor 66 and a decelerator 68 configured to decelerate the rotation of the stepping motor 66. A gear 549 connected to the journal 542 of the center core 535 is engaged with the decelerator 68. The stepping motor 66 rotates the center core 535 via the decelerator 68 and the gear 549. A worm gear may be, for example, used as the decelerator 68. The driving mechanism 64 further includes a slitted disc 72 which rotates together with the gear 549 and a photointerrupter 74 which detects a rotation angle of the slitted disc 72 (i.e. rotation angle of the center core 535 (rotational displacement amount from a reference position)).

The rotation angle of the center core 535 is controlled, for example, by the number of drive pulses applied to the stepping motor 66. The driving mechanism 64 includes a control circuit 640 configured to control the rotation of the stepping motor 66. The control circuit 640 includes, for example, a control IC 641, an input driver 642, an output driver 643 and a semiconductor memory 644. A detection signal from the photointerrupter 74 is input to the control IC 641 via the input driver 642. The control IC 641 detects the current rotation angle (position) of the center core 535 based on the input signal. Meanwhile, an information signal on the current sheet size is sent from an image formation controller 650 of the image forming apparatus 1 to the control IC 641. After receiving the information signal from the image formation controller 650, the control IC 641 reads information on a rotation angle suitable for the sheet size from the semiconductor memory (ROM) 644 to output drive pulses required to reach a target rotation angle in a predetermined cycle. The drive pulses are applied to the stepping motor 66 via the output driver 643. The stepping motor 66 operates in accordance with the drive pulses. It should be noted that if only the reference position needs to be detected upon controlling the stepping motor 66, the slitted disc 72 may be used as an index member. At the reference position, the index member may be detected by the photointerrupter 74.

Belt Unit and Reference Roller

The belt unit 510 and the reference roller 520 are described with reference to FIGS. 2 and 3 again.

The belt unit 510 includes the first roller 512, the second roller 513 arranged between the IH coil unit 530 and the first roller 512, and the belt 511 wound on the first and second rollers 512, 513. The reference roller 520 nips the belt 511 with the first roller 512, so that a flat nip is formed between the reference roller 520 and the belt 511.

The belt 511 includes, for example, a nickel electroformed substrate from 30 μm to 50 μm in thickness, a silicon rubber layer laminated on the nickel electroformed substrate and a release layer (e.g. PFA layer) formed on the silicon rubber layer. The cylindrical second roller 513 may be, for example, 30 mm in outer diameter. The second roller 513 includes a cylindrical iron substrate and a release layer (e.g. PFA layer) from 0.2 mm to 1.0 mm in thickness formed on the outer circumferential surface of the iron substrate. The first roller 512 is formed, for example, in a cylindrical shape. The first roller 512 includes a core roller made of stainless steel of 45 mm in outer diameter and a sponge layer made of silicon rubber from 5 mm to 10 mm in thickness configured to cover the outer circumferential surface of the core roller. The reference roller 520 is formed, for example, in a cylindrical shape of 50 mm in outer diameter. The reference roller 520 includes a core roller made of stainless steel, a sponge layer made of silicon rubber from 2 mm to 5 mm in thickness configured to cover the outer circumferential surface of the core roller and a release layer (e.g. PFA layer). A metallic core material of the reference roller 520 may be formed, for example, using Fe or Al. A Si rubber layer may be formed on this core material. Further, a fluororesin layer may be formed on the outer surface of the Si rubber layer.

The fixing unit 500 further includes a tension roller 540 configured to apply tension to the belt 511. The tension roller 540 includes a trunk 310 abutting the inner surface of the belt 511 which travels from the second roller 513 to the first roller 512 and journals 320 extending from the ends of the trunk 310 (see FIG. 3). It is likely that the tension roller 540 prevents the traveling belt 511 from sagging and stabilizes the travel of the belt 511. The trunk 310 is preferably made of aluminum. The more thermally conductive trunk 310 made of aluminum results in less variation in the temperature distribution of the belt.

The fixing unit 500 includes a thermistor 62 configured to measure the temperature of the belt 511 in a non-contact manner. The thermistor 62 attached to the platform 200 is preferably arranged in an area where a large quantity of heat is generated by the induction heating. It should be noted that the temperature of the belt 511 may be measured using a thermostat instead of the thermistor 62. Alternatively, the thermistor 62 or thermostat may be arranged in the second roller 513. The arrangement of a temperature measuring element such as a thermistor or thermostat contributes to improved safety at the time of an abnormal rise of the temperature.

Heat Quantity Control for Belt Unit

Figure 7A:
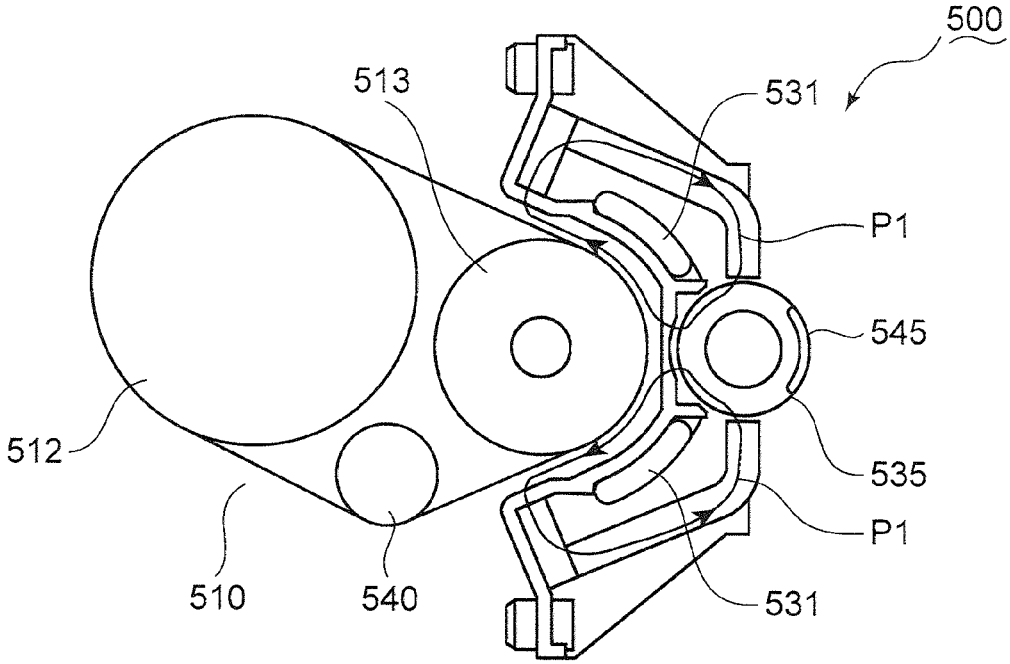
FIG. 7A schematically shows a temperature control by the rotation of the center core shown in FIG. 4.
Figure 7B:
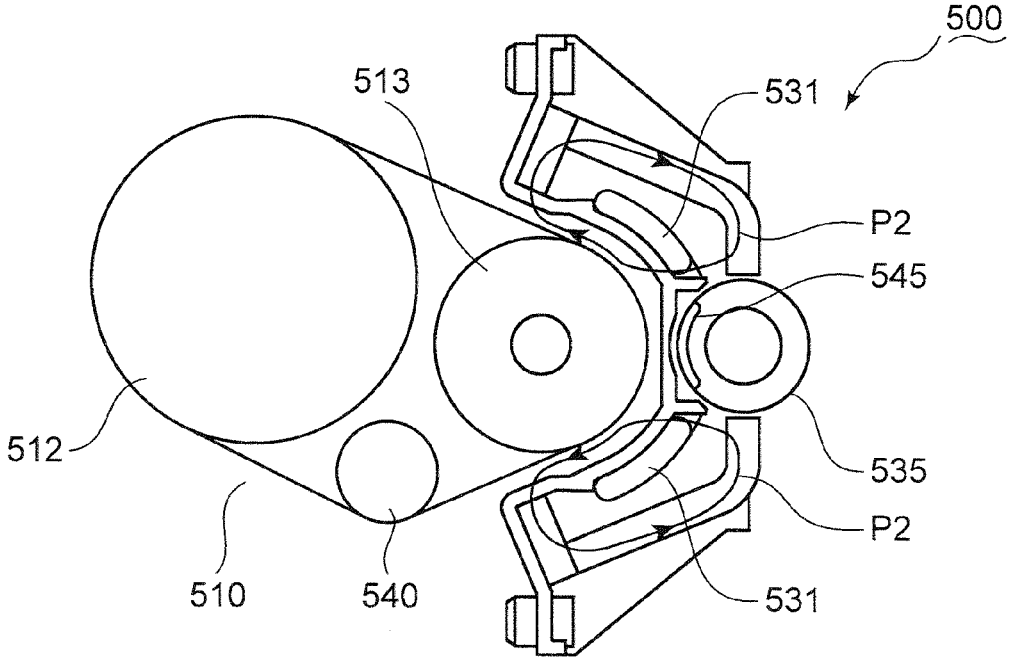
FIG. 7B schematically shows the temperature control by the rotation of the center core shown in FIG. 4.

FIGS. 7A and 7B schematically show a heat quantity control for the belt unit 510. FIG. 7A is a sectional view schematically showing the fixing unit 500 in which the magnetic shielding plates 545 are arranged at a retracted position where the magnetic shielding plate 545 is the most distant from the second roller 513. FIG. 7B is a sectional view schematically showing the fixing unit 500 in which the magnetic shielding plates 545 are arranged at a proximate position where the magnetic shielding plates 545 is the most proximate to the second roller 513. The heat quantity control for the belt unit 510 is described with reference to FIGS. 6, 7A and 7B.

The rotation of the center core 535 by the driving mechanism 64 is used for the heat quantity control of the belt unit 510. A fixing process for a larger sheet requires heat supply in a wider area whereas a fixing process for a smaller sheet requires heat supply in a narrower area. If the larger sheet passes through the fixing unit 500, the driving mechanism 64 rotates the center core 535 so that the magnetic shielding plates 545 reach the retracted position. If the smaller sheet passes through the fixing unit 500, the driving mechanism 64 rotates the center core 535 so that the magnetic shielding plates 545 reach the proximate position.

While the magnetic shielding plates 545 are at the retracted position, the magnetic lines in the magnetic field generated by the coil 531 pass through the second roller 513 and the belt 511 via first paths P1 passing through the side cores 533, the arch cores 534 and the center core 535. As a result, an eddy current is generated in the ferromagnetic belt 511 and the second roller 513. The eddy current generates Joule heats corresponding to specific resistances of the respective materials. Thus, the belt 511 and the second roller 513 are entirely heated without being shielded by the magnetic shielding plates 545.

The magnetic shielding plates 545 at the proximate position are located between the center core 535 and the second roller 513. Accordingly, it is less likely that second paths P2 of the magnetic lines in the magnetic field generated by the coil 531 pass through the center core 535. Thus, the paths of the magnetic lines in the magnetic field generated by the coil 531 are switched by the rotation of the center core 535. As a result, less heat is generated in parts of the belt 511 and the second roller 513 which faces both ends of the center core 535 where the magnetic shielding plates 545 are arranged.

Belt Unit

Figure 8:
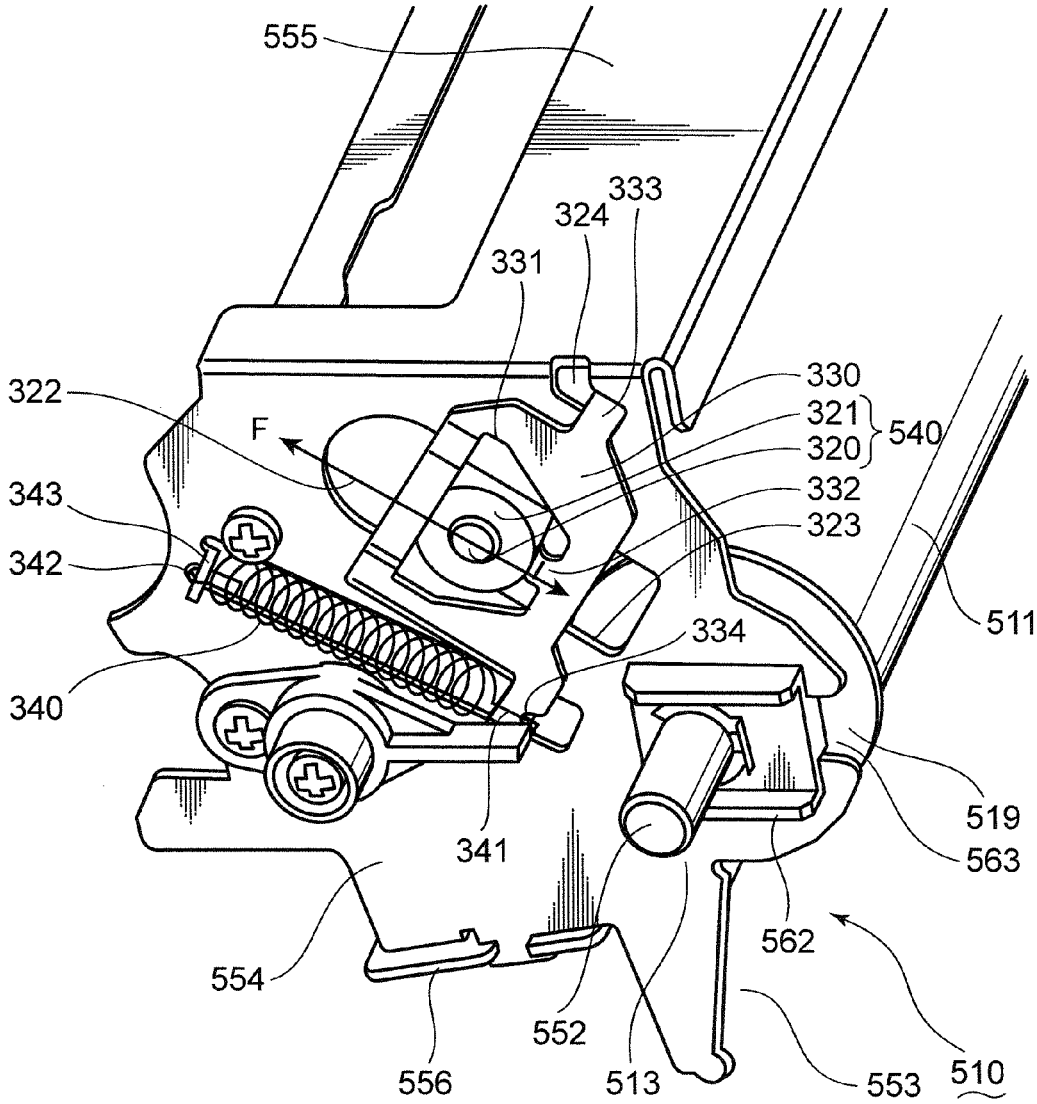
FIG. 8 is a schematic perspective view of a belt unit provided in the fixing unit shown in FIG. 2.

FIG. 8 is a perspective view of the belt unit 510. The belt unit 510 is described with reference to FIGS. 2, 3 and 8.

The second roller 513 of the belt unit 510 includes a substantially cylindrical trunk 518 (see FIG. 3) which forms a travel path of the belt 511 along the arcuate heating zone, journals 552 projecting from the end surfaces of the trunk 518, bearings 561 (see FIG. 3) connecting the trunk 518 with the journal 552 and a pair of disk flanges 519 extending along the both edges of the belt 511. The flanges 519 larger in diameter than the trunk 518 define a maximum fluctuation range of the travel of the belt 511. The flanges 519 appropriately determine a lateral position of the belt 511 in between them. The trunk 518 rotates about the journal 552 via the bearing 561. A drive force for rotating the trunk 518 is transmitted from the first roller 512 via the belt 511.

A bracket 562 is mounted on the journal 552 of the second roller 513. The bracket 562 is used to connect the belt unit 510 with a supporting frame (not shown) configured to support the reference roller 520.

As shown in FIG. 8, the belt unit 510 includes a holding frame 553. The holding frame 553 includes a support plate 554 arranged between the bracket 562 and the flange 519, an entrance wall 555 arranged at an upstream side in the sheet conveying direction, and an exit wall 556 arranged at the opposite side to the entrance wall 555. The bracket 562 is inserted into a notch 563 defined at the periphery of the support plate 554, which appropriately supports the second roller 513.

As shown in FIG. 8, the tension roller 540 includes a bearing 321 mounted on the journal 320. The support plate 554 is formed with a slit 322 for accommodating the bearing 321. A support edge 323 which determines the outline of the slit 322 supports the bearing 321. Thus, the holding frame 553 is exemplified as a support element configured to support the tension roller 540.

The slit 322 defined in the support plate 554 extends in a first direction F substantially parallel to a travel zone determined by the second and tension rollers 513, 540. In the travel zone determined by the second and tension rollers 513, 540, the belt 511 substantially coincides with a common tangent to the trunk 518 between the second roller 513 and the trunk 310 of the tension roller 540. The slit 322 allows the tension roller 540 to displace in the first direction F.

As shown in FIG. 2, the tension roller 540 bents the belt 511 outwardly from a common tangent T between the first and second rollers 512, 513. Accordingly, the tension of the belt 511 is appropriately maintained by a component (force component orthogonal to the common tangent T) of the force that displaces the tension roller 540 in the first direction F. Thus, it is likely that the tension roller 540 appropriately prevents the belt 511 from sagging.

The holding frame 553 further includes a slide plate 330 extending along the outer surface of the support plate 554. A substantially trapezoidal opening 331 is formed in the center of the substantially flat slide plate 330. The bearing 321 of the tension roller 540 appears through the opening 331.

The slide plate 330 includes a first claw 332 projecting into the opening 331. The first claw 332 bent toward the slit 322 formed in the support plate 554 comes into contact with the circumferential surface of the bearing 321 of the tension roller 540.

The support plate 554 is formed with an auxiliary slit 324 extending in the first direction F. The auxiliary slit 324 extends toward a corner between the support plate 554 and the entrance wall 555. The slide plate 330 includes a second claw 333. The second claw 333 extending from the periphery of the slide plate 330 is bent toward the auxiliary slit 324 and engaged with the support plate 554.

The holding frame 553 further includes a coil spring 340. The coil spring 340 includes a first end 341 engaged with the periphery of the slide plate 330 and a second end 342 engaged with the support plate 554. The periphery of the slide plate 330 defines a notch 334 to be engaged with the first end 341 of the coil spring 340. The support plate 544 includes an engaging claw 343 projecting outwardly. The second end 342 of the coil spring 340 is engaged with the engaging claw 343. The coil spring 340 is extended substantially in parallel to the first direction F between the notch 334 and the engaging claw 343. Thus, the coil spring 340 biases the slide plate 330 in the first direction F.

The slide plate 330 biases the tension roller 540 in the first direction F via the first claw 332. The bearing 321 mounted on the journal 320 of the tension roller 540 is guided by the slit 322 formed in the support plate 554 to move in the first direction F. Thus, the tension roller 540 biased in a biasing direction along an extending direction of the belt between the second and tension rollers 513, 540 moves in the first direction F according to the tension of the belt 511. Since a distance between the side cores 533 and the belt 511 at the endpoint E (see FIG. 2) of the heating zone does not unnecessarily vary, it is less likely that the quantity of heat applied to the belt 511 becomes sensitive to the tension variation of the belt 511.

In this embodiment, the slide plate 330 and the coil spring 340 are exemplified as a biasing mechanism configured to bias the tension roller 540 in the first direction F. Alternatively, another structure and/or element configured to bias the tension roller 540 in the first direction F may be used as the biasing mechanism.

The fixing unit 500 according to this embodiment includes the IH coil unit 530. Alternatively, another heating mechanism configured to heat the belt 511 and/or the second roller 513 may be used instead of the IH coil unit 530.

In this embodiment, the tension roller 540 is used as a tensioner. Alternatively, another known structure or element configured to appropriately apply tension to the belt 511 may be used as the tensioner.

In this embodiment, the coil spring 340 is extended in the first direction along the extending direction of the belt 511 between the second roller 513 and the tension roller 540. Alternatively the coil spring 340 may be extended in a different direction from the first direction according to this embodiment because the extending direction of the slit determines the displacing direction of the tension roller 540.

This application is based on Japanese Patent application No. 2010-146675 filed in Japan Patent Office on Jun. 28, 2010, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A fixing unit for fixing a toner image, comprising:

a heating mechanism configured to define an arcuate heating zone;

a first roller including a circumferential surface;

a second roller parallel to the first roller and including a circumferential surface extending along the heating zone;

a tensioner with a tension roller parallel to the first and second rollers and including a circumferential surface;

a belt wound on the circumferential surfaces of the first and second rollers and the tension roller; and a biasing mechanism configured to bias the tension roller in a biasing direction along an extending direction of the belt between the second roller and the tension roller.

2. The fixing unit according to claim 1, further comprising a support element configured to support the tensioner, wherein:

the tension roller includes a trunk held in contact with the belt and a journal extending from the trunk; and the support element includes a support plate formed with a slit for guiding the journal in the biasing direction.

3. The fixing unit according to claim 2, wherein the trunk is made of aluminum.

4. The fixing unit according to claim 1, wherein:

the heating mechanism for induction-heating the belt includes a coil which forms a coil surface along the heating zone and a magnetic element configured to define a path of magnetic lines in a magnetic field generated from the coil;

the magnetic element includes paired side cores configured to define a start point and an end point of the heating zone, a center core arranged at an intermediate position of the heating zone and paired arch cores extending between the paired side cores and the center core; and the center core includes a shielding area configured to shield the path of the magnetic lines propagating toward the second roller.

5. The fixing unit according to claim 4, wherein the heating mechanism includes a driving mechanism configured to rotate the center core.

6. An image forming apparatus, comprising the fixing unit according to claim 1.

* * * * *